US007341359B2

(12) United States Patent
Hwang et al.

(10) Patent No.: US 7,341,359 B2
(45) Date of Patent: Mar. 11, 2008

(54) LIGHTING DEVICE USING COLD CATHODE FLUORESCENT LAMP

(75) Inventors: Jae-Sung Hwang, Siheung-si (KR); Han Hur, Suwon-si (KR); Min-Su So, Daejeon (KR)

(73) Assignee: Kumho Electric, Inc., Seoul (KR)

( * ) Notice: Subject to any disclaimer, the term of this patent is extended or adjusted under 35 U.S.C. 154(b) by 271 days.

(21) Appl. No.: 11/192,847

(22) Filed: Jul. 27, 2005

(65) Prior Publication Data

US 2006/0028813 A1 Feb. 9, 2006

(30) Foreign Application Priority Data

Aug. 9, 2004 (KR) ..... 10-2004-0062328

(51) Int. Cl.
*F21V 23/02* (2006.01)

(52) U.S. Cl. ..... 362/223; 362/260; 362/217; 362/221; 362/375

(58) Field of Classification Search ..... 362/223, 362/225, 363, 455, 217, 221, 374, 375, 260, 362/249, 235, 265
See application file for complete search history.

(56) References Cited

U.S. PATENT DOCUMENTS 2,631,225 A * 3/1953 Gadomski ..... 362/224
3,875,398 A * 4/1975 Brindley ..... 362/183
4,725,931 A * 2/1988 Bourdon ..... 362/151
6,558,020 B1 * 5/2003 Holzer ..... 362/221
7,038,397 B2 * 5/2006 Komatsu et al. ..... 315/276
2004/0179357 A1 * 9/2004 Kappe ..... 362/222

FOREIGN PATENT DOCUMENTS

KR 1020040039266 A 5/2004

* cited by examiner

*Primary Examiner*—Thomas M. Sember
(74) *Attorney, Agent, or Firm*—Needle & Rosenberg, P.C.

(57) ABSTRACT

Disclosed herein is a lighting device using a cold cathode fluorescent lamp (CCFL), which has reduced size and volume and concentrates light from the CCFL, thus enhancing its luminance. The lighting device includes a casing which is open on a surface thereof, thus having an open part, with an ON/OFF switch button which protrudes through a sidewall of the casing and is used to turn on or off the lighting device. A reflective plate is inserted into the casing through the open part, with a circuit board provided on a predetermined position of the reflective plate. A CCFL is inserted into the reflective plate and electrically connected to the circuit board with a cover assembled with the casing and receiving the CCFL between the casing and the cover. A socket is assembled with each end of the casing that supports both the CCFL and the cover, and is electrically connected to the circuit board.

5 Claims, 4 Drawing Sheets

LIGHTING DEVICE USING COLD CATHODE FLUORESCENT LAMP

CROSS REFERENCE TO RELATED APPLICATIONS

The present application claims priority to Korean Patent Application No. KR 2004-0062328, filed Aug. 9, 2004, which application is incorporated herein fully by this reference.

BACKGROUND OF THE INVENTION

1. Field of the Invention

The present invention relates generally to lighting devices using cold cathode fluorescent lamps and, more particularly, to a lighting device using a cold cathode fluorescent lamp, which has reduced size and volume and concentrates light from the lamp, thus enhancing its luminance.

2. Description of the Related Art

Generally, cold cathode fluorescent lamps (CCFL) have been used as backlights in liquid crystal display (LCD) apparatuses and, in recent years, the demand for CCFLs has rapidly increased according to the development and spread of information technology equipment.

The CCFL is lit up through an operating principle similar to the operating principle of conventional hot cathode fluorescent lamps (HCFL) that are well-known to those skilled in the art. However, unlike the HCFL which is lit up by electrons emitted by heat, the CCFL is lit up by electrons emitted by electric fields applied to electrodes, so that the CCFL does not generate heat.

Therefore, the CCFL has been preferably used as a lighting device for advertisement apparatuses and as a lighting device for LCD apparatuses. Particularly, the CCFL has been preferably used as a lighting device installed in a show window which is provided in a store and displays therein food that may easily perish and spoil when the food is heated, so that the CCFL efficiently displays perishable and spoilable food without causing the food to perish or spoil.

However, according to the recent trend of compactness, smallness and slimness of LCD apparatuses and advertisement apparatuses, lighting devices which are compact, small and slim and provide high luminance so as to be efficiently used with the apparatuses have been required.

SUMMARY OF THE INVENTION

Accordingly, the present invention has been made keeping in mind the above problems occurring in the related art, and an object of the present invention is to provide a lighting device using a cold cathode fluorescent lamp (CCFL), which has reduced size and volume, thus accomplishing the recent trend of compactness, smallness and slimness of the CCFL, and concentrates light from the CCFL, thus enhancing its luminance.

In order to accomplish the above object, the present invention provides a lighting device using a CCFL, comprising: a casing open on a surface thereof, thus having an open part, with an ON/OFF switch button protruding through a sidewall of the casing, used to turn on or off the lighting device; a reflective plate inserted into the casing through the open part of the casing, with a circuit board provided on a predetermined position of the reflective plate; a CCFL inserted into the reflective plate and electrically connected to the circuit board; a cover assembled with the casing and receiving the CCFL between the casing and the cover; and a socket assembled with each end of the casing and supporting both the CCFL and the cover, and electrically connected to the circuit board.

The reflective plate preferably further comprises a plurality of skirts which protrude from opposite edges of the lower surface of the reflective plate while being inclined at an angle from 90 degrees to 180 degrees, with the CCFL installed in a space between the skirts, so that the skirts concentrate light from the CCFL. Furthermore, locking rails are preferably formed along the opposite edges of the upper surface of the reflective plate, with locking blades formed along ends of the locking rails, while locking steps are preferably formed on the inner surface of the casing and engage with the locking blades of the locking rails.

Furthermore, the cover preferably comprises taper parts which are provided on opposite sidewalls of the cover by gradually thickening in a direction towards the upper end of each of the sidewalls, so that the taper parts of the casing are fitted over opposite sidewalls of the casing.

Furthermore, the socket preferably comprises: an inserting protrusion provided on a predetermined surface of the socket and inserted into the casing while being guided by a step formed on the inner surface of the casing, with a switch hole formed on a surface of the inserting protrusion and receiving the ON/OFF switch button therein; and a support protrusion provided on a lower part of the socket below the inserting protrusion so that the support protrusion surrounds and supports the outer surface of the cover, with an end of the CCFL being inserted into the support protrusion.

Furthermore, the socket preferably receives therein a receptacle which is electrically connected to the circuit board so that the receptacle is electrically connected to the CCFL through the circuit board, with a plug hole formed on the end surface of the socket opposite the receptacle so that the plug hole exposes the receptacle to the outside. A finishing cover is preferably detachably inserted into the plug hole, thus closing the plug hole.

Furthermore, a support clamp having an installation hole is preferably detachably mounted to the casing, wherein the casing is provided with sliding grooves on opposite sidewalls thereof and each end of opposite sidewalls of the support clamp is provided with a locking blade, so that the locking blades of the clamp movably engage with the sliding grooves of the casing.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
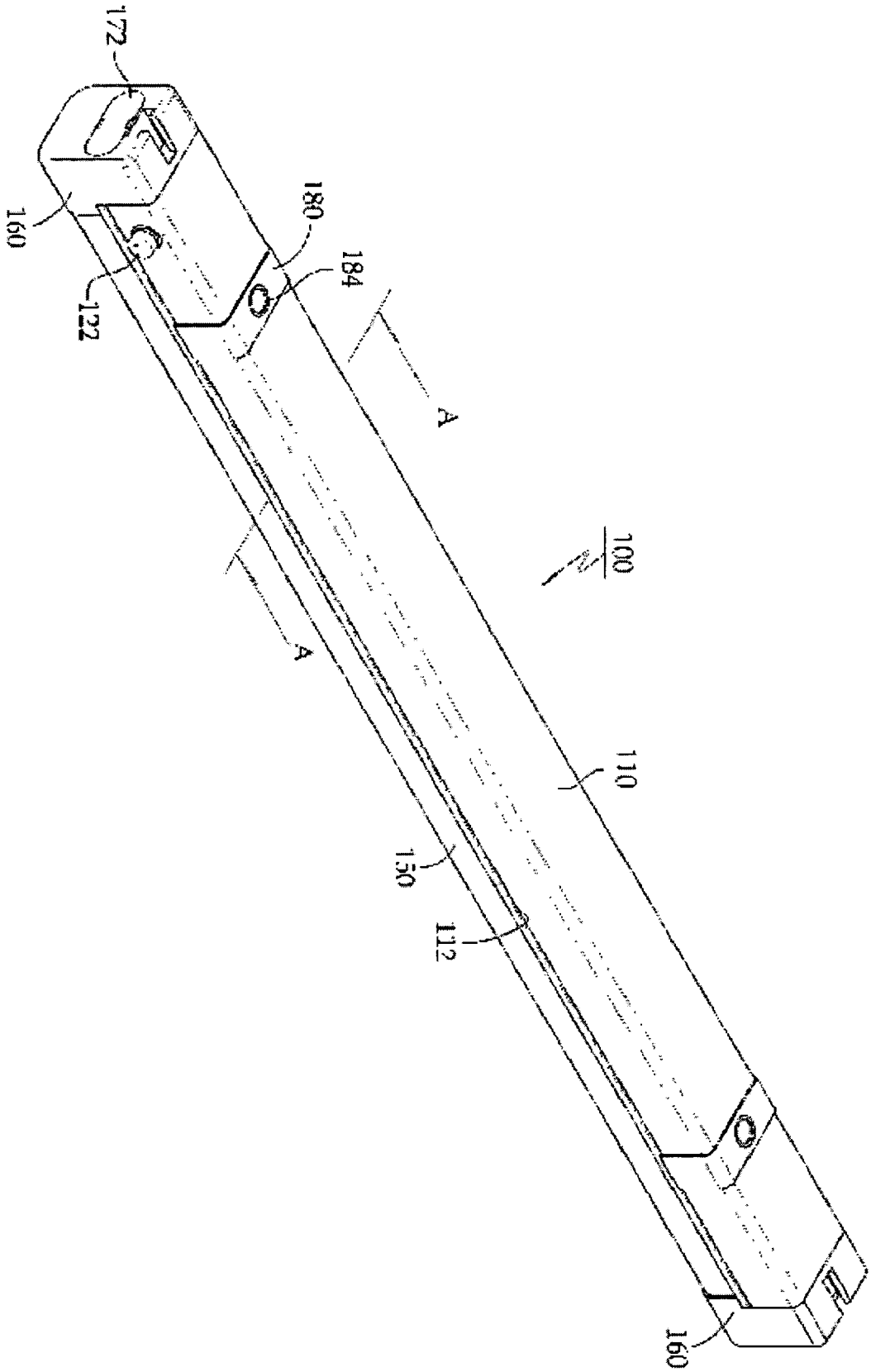
FIG. 1 is a perspective view illustrating the appearance of a lighting device using a CCFL according to the present invention.

Reference now should be made to the drawings, in which the same reference numerals are used throughout the different drawings to designate the same or similar components.

FIGS. 1 through 4 are views illustrating a lighting device using a cold cathode fluorescent lamp (CCFL) according to the present invention.

Figure 2:
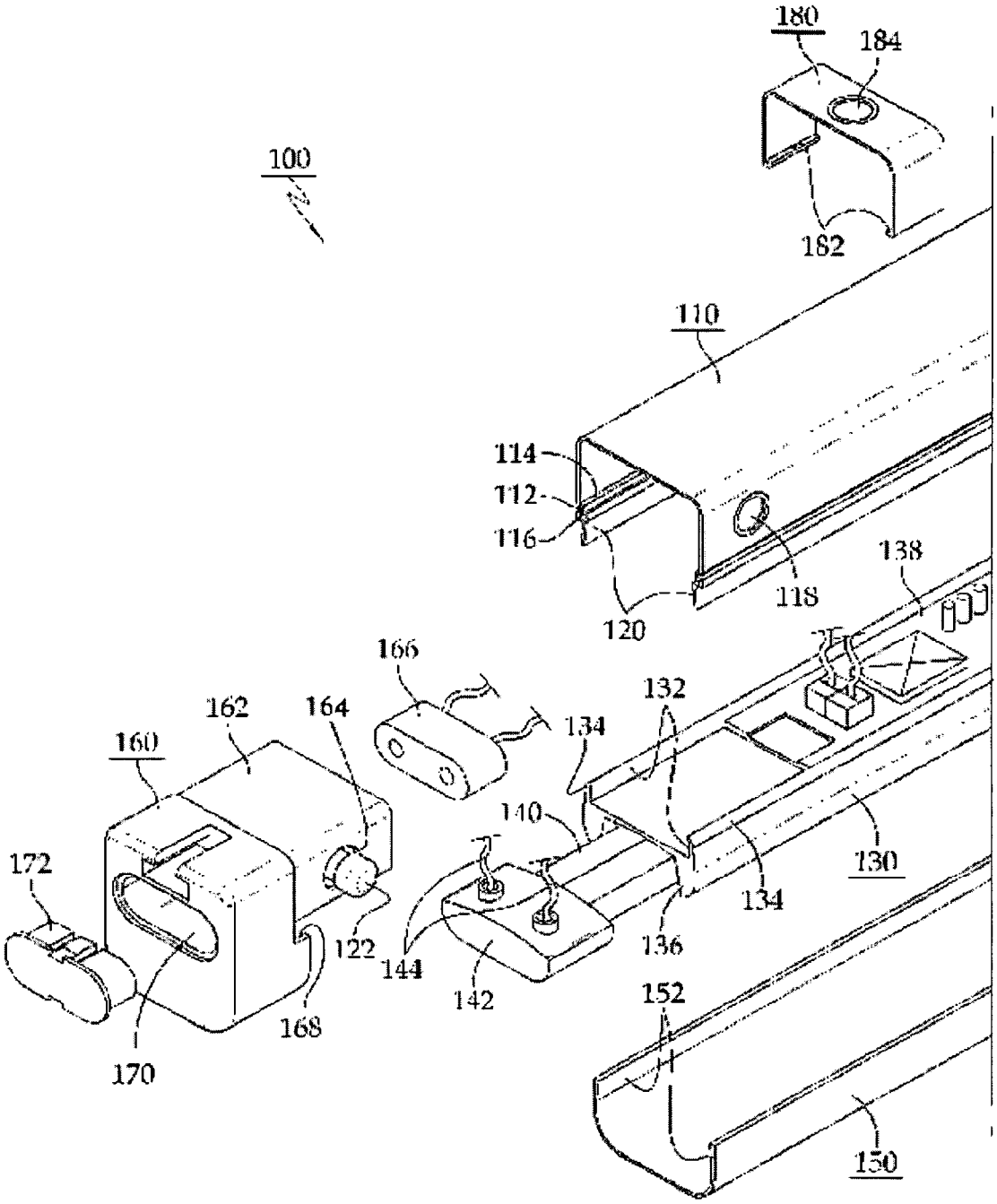
FIG. 2 is an exploded perspective view illustrating the construction of part of the lighting device according to the present invention.
Figure 3:
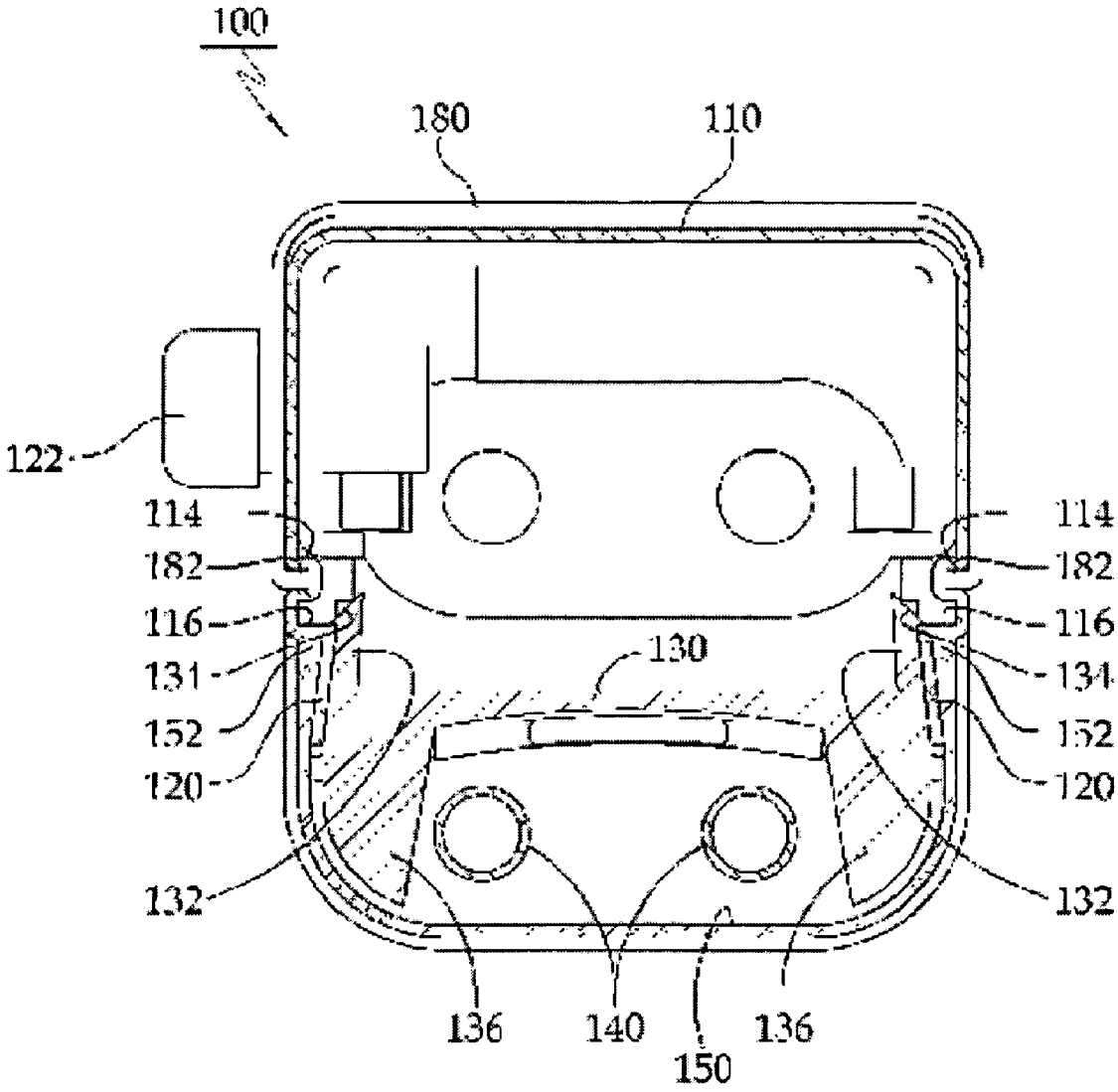
FIG. 3 is a sectional view taken along the line A-A of FIG. 1.
Figure 4:
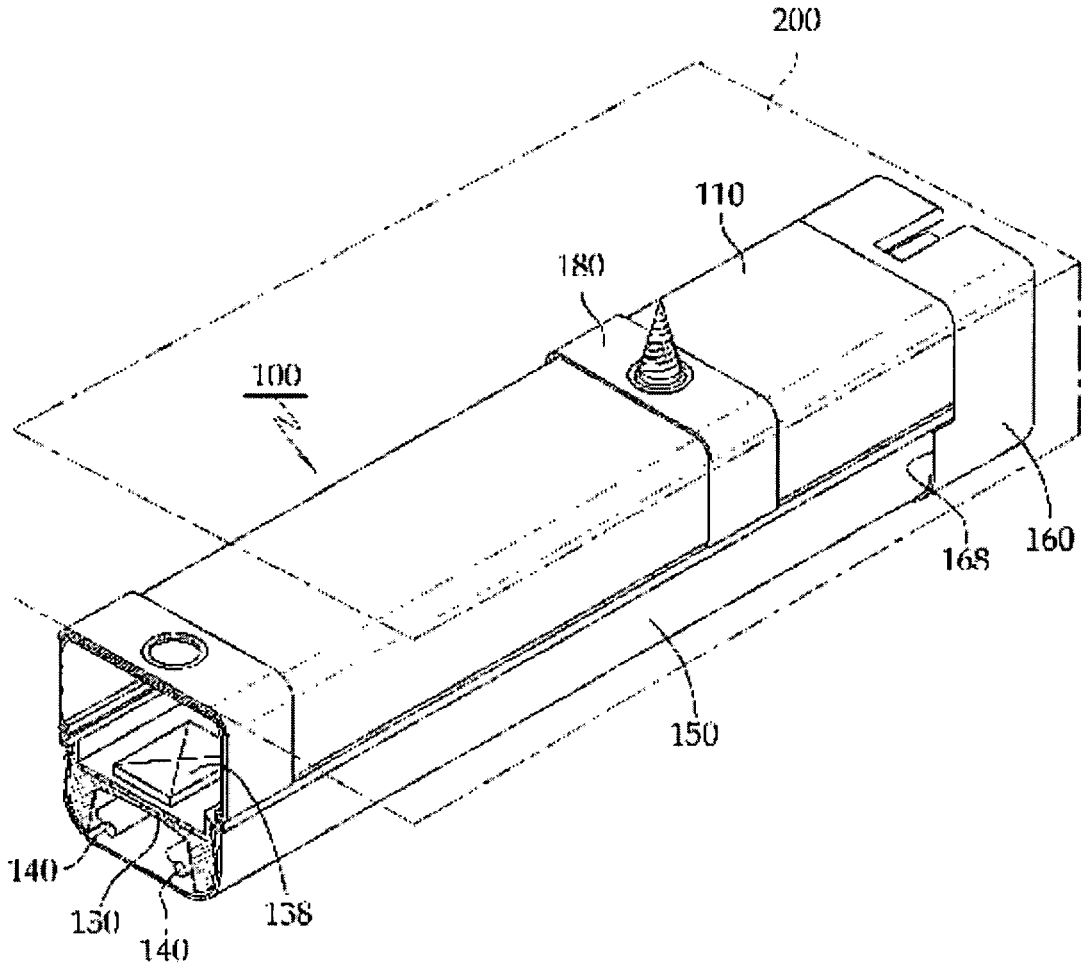
FIG. 4 is a perspective view illustrating an example of use of the lighting device according to the present invention, in which the lighting device is attached to a ceiling.

As shown in FIGS. 1 and 2, the lighting device 100 comprises a casing 110, a reflective plate 130, a CCFL 140, a cover 150, a socket 160, and a support clamp 180.

The casing 110 is a longitudinal body which is open along a lower end thereof, so that the casing 110 has a U-shaped cross-section. A sliding groove 112 is longitudinally formed along the outer surface of each of opposite sidewalls of the casing 110.

First and second locking steps 114 and 116 are longitudinally formed along the inner surface of each of the opposite sidewalls of the casing 110 such that the locking steps 114 and 116 are placed at upper and lower positions on the inner surface, respectively. The lower portions of the opposite sidewalls of the casing 110 under the second locking steps 116 are widened, thus providing outward inclined edges 120.

Furthermore, a switch hole 118 is formed through a sidewall of the casing 110 and receives therein an ON/OFF switch button 122 to turn on or off the lighting device 100.

The reflective plate 130 is inserted into the casing 110 through the open part of the casing 110.

The reflective plate 130 has locking rails 132 and skirts 136. The locking rails 132 are formed along the opposite edges of the upper surface of the reflective plate 130, while the skirts 136 are formed along the opposite edges of the lower surface of the reflective plate 130. A locking blade 134 is outwardly formed along an upper end of each of the locking rails 132 and engages with the second locking step 116 of the casing 110.

The skirts 136 prevent diffusion of light radiated from the CCFL 140, which will be described herein later, thus concentrating the light.

The upper surface of the reflective plate 130 is provided with a circuit board 138 which supports thereon, for example, an inverter.

The CCFL 140 is installed in the reflective plate 130. In the above state, the CCFL 140 is inserted through a gap between the two skirts 136 of the reflective plate 130.

An insulating body 142, made of flexible silicone, is provided on each end of the CCFL 140, with an electric wire 144 extending from the insulating body 142 and electrically connecting the CCFL 140 to the circuit board 138.

The cover 150 is made of a transparent material and is fitted over the outward inclined edges 120 of the casing 110, thus closing the open part of the casing 110 and covering both the CCFL 140 and the skirts 136 of the reflective plate 130 installed in the casing 110. The skirts 136 are configured such that the angles of the skirts 136 can be adjusted from 90 degrees to 180 degrees, so that all or part of the displayed products may be illuminated with light from the CCFL 140 due to the skirts 136. Thus, the lighting device using a CCFL according to the present invention can be used to decorate a store and/or highlight products displayed in the store.

The cover 150 to be assembled with the casing 110 has a taper part 152 which is provided on each sidewall of the cover 150 by gradually thickening in a direction towards the upper end of the sidewall. Thus, the outward inclined edges 120 of the casing 110 can be fitted into the taper sidewalls of the cover 150 due to the taper part 152.

The socket 160 is assembled with each end of the casing 110 and supports both the CCFL 140 and the cover 150 which are mounted to the casing 110.

The socket 160 is provided with an inserting protrusion 162 on a surface thereof which faces an end of the casing 110, so that the inserting protrusion 162 is inserted into the end of the casing 110 while being guided by the first locking steps 114 formed on the inner surfaces of the casing 110. A switch hole 164 is formed on a surface of the inserting protrusion 162 and receives the ON/OFF switch button 122 which protrudes through the switch hole 118 of the casing 110.

The lower part of the socket 160 below the inserting protrusion 162 is provided with a support protrusion 168. The support protrusion 168 has a shape corresponding to the cross-section of the cover 150 and surrounds the outer surface of the cover 150, with the insulating body 142 of the CCFL 140 being inserted into the support protrusion 168.

The socket 160 receives therein a receptacle 166. The receptacle 166 is electrically connected to the circuit board 138 so that the circuit board 138 is electrically connected to both the receptacle 166 and the CCFL 140. Furthermore, a plug hole 170 is formed on an end surface of the socket 160 opposite the receptacle 166 so that the plug hole 170 can expose the receptacle 166 to the outside. Thus, a plug connected to a power cord or a separate connection cord may be electrically connected to the receptacle 166 through the plug hole 170.

A finishing cover 172 having a shape corresponding to the shape of the plug hole 170 may be detachably inserted into the plug hole 170. Thus, the finishing cover 172 closes the plug hole 170 when no plug is connected to the receptacle 166 through the plug hole 170.

The support clamp 180 has a U-shaped cross-section, corresponding to the cross-section of the casing 110, and is fitted over an upper part of the casing 110.

The above-mentioned U-shaped support clamp 180 is detachably fitted over the casing 110. Each end of opposite sidewalls of the support clamp 180 is provided with a locking blade 182. The locking blades 182 of the clamp 180 movably engage with the sliding grooves 112 longitudinally formed along the outer surfaces of the opposite sidewalls of the casing 110.

Furthermore, an installation hole 184, through which a user can install the lighting device 100 in a desired place, is formed through the upper surface of the support clamp 180. The installation hole 184 is preferably formed through counter sinking.

The above-mentioned parts of the lighting device 100 using a CCFL according to the present invention will be assembled into a single body and the assembled lighting device will be installed as follows.

To assemble the parts of the lighting device 100 into a single body, the reflective plate 130 is inserted into the casing 110 through the open part of the casing 110 until the locking blades 134 of the locking rails 132 engage with the second locking steps 116 of the casing 110.

In the above case, the upper surface of the reflective plate 130 is provided with the circuit board 138 which is electrically connected to both the CCFL 140 and the receptacle 166 of the socket 160. A slim inverter, to supply voltage and current having a frequency appropriate to drive the CCFL 140, is installed on the circuit board 138.

When the taper parts 152 of the transparent cover 150 are fitted over the outward inclined edges 120 formed on the lower part of the casing 110 with the CCFL 140 placed in the gap between the skirts 136 of the reflective plate 130, the outward inclined edges 120 are compressed by the taper parts 152. Thus, the cover 150 is assembled with the casing 110. Thereafter, two sockets 160 are mounted to opposite ends of the casing 110.

In the above case, the inserting protrusion 162 of each of the sockets 160 is inserted into the upper portion of each end of the casing 110 above the first steps 114, so that the support protrusion 168 of the socket 160 surrounds and supports the outer surface of the cover 150. The insulating body 142 of the CCFL 140 is inserted into the support protrusion 168 (see FIG. 1).

After the lighting device 100 has been completely assembled, the lighting device 100 is mounted to a desired place on, for example, a ceiling 200 by means of a plurality of support clamps 180.

In the above case, the support clamps 180 are attached to the desired location on the ceiling 200 prior to mounting the lighting device 100 to the clamps 180. That is, each of the support clamps 180 is attached to the ceiling 200 by means of a flat countersunk head screw which passes through the installation hole 184 of the clamp 180. After the support clamps 180 are completely attached to the ceiling 200, the assembled lighting device 100 is mounted to the clamps 180. In the present invention, to mount the assembled lighting device 100 to the clamps 180, the casing 110 of the assembled lighting device 100 may be vertically fitted into the open parts of the support clamps 180. When the casing 110 is vertically fitted into the support clamps 180 as described above, the opposite sidewalls of each clamp 180 are elastically opened to allow the casing 110 to be inserted into the open parts of the clamps 180 until the locking blades 182 of the clamps 180 are brought into movable engagement with the sliding grooves 112 of the lighting device 100.

Alternatively, after the support clamps 180 have been completely mounted to the ceiling 200, the assembled lighting device 100 may be horizontally inserted into the support clamps 180 on the ceiling 200 while the sliding grooves 112 of the casing 110 are longitudinally aligned with and guided by the locking blades 182 of the fixed clamps 180.

Thereafter, a plug (not shown) connected to a power cord is inserted into the plug hole 170 of the socket 160 so that the plug is electrically connected to the receptacle 166 in the socket 160. When the ON/OFF switch button 122 on the casing 110 is pressed by a user after the plug has been electrically connected to the receptacle 166, the lighting device 100 is turned on. Thus, the CCFL 140 is electrically activated to emit light.

In the operation of the lighting device 100 according to the present invention, the diffusion of light radiated from the CCFL 140 is minimized due to the skirts 136 of the reflective plate 130. Thus, the light from the CCFL 140 is concentrated so that the luminance of the CCFL is increased.

Furthermore, all of the parts of the lighting device 100 according to the present invention are housed in the casing 110 and the sockets 160, so that the recent trend of smallness and slimness of the lighting device 100 can be accomplished.

As described above, the present invention provides a lighting device using a CCFL, which has reduced size and volume, thus accomplishing the recent trend of smallness and slimness of lighting devices, and which concentrates light from the CCFL while minimizing the diffusion of light. Furthermore, the lighting device of the present invention has a good appearance and may have twin CCFLs which generate a reduced amount of heat. Thus, the lighting device of the present invention is particularly preferred to be used in a place where it is required to prevent persons from feeling thermal discomfort due to a lighting device having high intensity of illumination, or in a place, such as a show window in a bakery, where the quality of displayed products may be easily changed by heat.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A lighting device using a cold cathode fluorescent lamp (CCFL), comprising:

a casing open on a surface thereof, thus having an open part, with an ON/OFF switch button which protrudes through a sidewall of the casing and is used to turn on or off the lighting device;

a reflective plate inserted into the casing through the open part of the casing, with a circuit board provided on a predetermined position of the reflective plate;

a CCFL inserted into the reflective plate and electrically connected to the circuit board;

a cover assembled with the casing and receiving the CCFL between the casing and the cover;

a socket which is assembled with each end of the casing, supports both the CCFL and the cover, and is electrically connected to the circuit board;

a plurality of skirts protruding from opposite edges of a lower surface of the reflective plate while being inclined at an angle from 90 degrees to 180 degrees, with the CCFL installed in a space between the skirts, so that the skirts concentrate light from the CCFL;

locking rails formed along opposite edges of an upper surface of the reflective plate, with locking blades formed along ends of the locking rails; and locking steps formed on an inner surface of the casing and engaging with the locking blades of the locking rails.

2. A lighting device using a cold cathode fluorescent lamp (CCFL), comprising:

a casing open on a surface thereof, thus having an open part, with an ON/OFF switch button which protrudes through a sidewall of the casing and is used to turn on or off the lighting device:

a reflective plate inserted into the casing through the open part of the casing, with a circuit board provided on a predetermined position of the reflective plate;

a CCFL inserted into the reflective plate and electrically connected to the circuit board;

a cover assembled with the casing and receiving the CCFL between the casing and the cover;

a socket which is assembled with each end of the casing, supports both the CCFL and the cover, and is electrically connected to the circuit board wherein the cover comprises taper parts provided on opposite sidewalls of the cover by gradually thickening in a direction towards an upper end of each of the sidewalls, so that the taper parts of the casing are fitted over opposite sidewalls of the casing;

wherein the socket comprises an inserting protrusion provided on a predetermined surface of the socket and inserted into the casing while being guided by a step formed on an inner surface of the casing, with a switch hole formed on a surface of the inserting protrusion and receiving the ON/OFF switch button therein and a support protrusion provided on a lower part of the socket below the inserting protrusion so that the support protrusion surrounds and supports an outer surface of the cover, with an end of the CCFL being inserted into the support protrusion.

3. The lighting device using a CCFL according to claim 1, further comprising:

a support clamp which has an installation hole and is detachably mounted to the casing, wherein the casing is provided with sliding grooves on opposite sidewalls thereof and each end of opposite sidewalls of the support clamp is provided with a locking blade, so that the locking blades of the clamp movably engage with the sliding grooves of the casing.

4. The lighting device using a CCFL according to claim 2, wherein the socket receives therein a receptacle which is electrically connected to the circuit board so that the receptacle is electrically connected to the CCFL through the circuit board, with a plug hole formed on an end surface of the socket opposite the receptacle so that the plug hole exposes the receptacle to the outside.

5. The lighting device using a CCFL according to claim 4, wherein a finishing cover is detachably inserted into the plug hole, thus closing the plug hole.

* * * * *